US005481977A

United States Patent [19]

Evans et al.

[11] Patent Number: 5,481,977

[45] Date of Patent: Jan. 9, 1996

[54] WORK-CONTROLLED LAUNCHING DEVICE WITH ACCUMULATOR

[75] Inventors: Paul S. Evans, Mesa; Jimmy D. Wiggins; Howard W. Ripy, both of Chandler, all of Ariz.

[73] Assignee: AlliedSignal Inc., Morris Township, N.J.

[21] Appl. No.: 100,580

[22] Filed: Jul. 30, 1993

[51] Int. Cl.[6] ..... F42B 3/00

[52] U.S. Cl. ..... 102/328; 102/381; 102/530

[58] Field of Search ..... 102/328, 329, 102/336, 372, 381, 530, 531

[56] References Cited

U.S. PATENT DOCUMENTS

| | | | |
|---|---|---|---|
| 1,338,676 | 5/1920 | Constantinesco et al. | 60/914 |
| 2,648,282 | 8/1953 | Swed | 102/25 |
| 2,652,781 | 9/1953 | Deardorff et al. | 60/914 |
| 2,771,032 | 11/1956 | Callahan | 102/25 |
| 2,857,889 | 3/1957 | Stott et al. | 60/638 |
| 2,857,890 | 10/1957 | Stott | 60/638 |
| 3,211,095 | 10/1965 | Foster | 102/25 |
| 3,578,008 | 5/1971 | Clark | 137/68 |
| 4,406,229 | 9/1983 | Greene et al. | 102/530 |
| 4,552,327 | 11/1985 | Carter | 60/413 |
| 4,950,458 | 8/1990 | Cunningham | 422/164 |
| 5,201,542 | 4/1993 | Thuen et al. | 280/736 |
| 5,226,669 | 7/1993 | Honda | 280/737 |

*Primary Examiner*—Peter A. Nelson
*Attorney, Agent, or Firm*—Jerry J. Holden; John R. Rafter

[57] ABSTRACT

A launching device with a work-controlled gas generator employs a dampening piston in combination with an accumulator volume to provide substantially uniform acceleration of a launching piston.

8 Claims, 6 Drawing Sheets

WORK-CONTROLLED LAUNCHING DEVICE WITH ACCUMULATOR

TECHNICAL FIELD

This invention pertains generally to solid-propellant gas generators, and more specifically to marine launching devices which employ such generators.

BACKGROUND OF THE INVENTION

Some current marine launching devices employ a solid pyrotechnic material (hereinafter "propellant") to generate gas which is delivered through a choked nozzle. In such configurations, motive gas is delivered at a constant mass flow rate. The gas drives a launching piston which in turn launches a vehicle such as a torpedo or countermeasure.

In general, to achieve a constant mass flow rate, existing devices use nozzle control as opposed to work control. The latter is characterized by use of the generated gas to pressurize a control volume operatively associated with an actuator. The performance of a gas generator in a work-control configuration is sensitive to the load placed on the actuator. The internal contents of both the launching device and the device which is launched may be sensitive to the g-forces associated with launch. Accordingly, there is a need for a launching device which ensures a relatively uniform acceleration during the launching cycle. In addition, the device should provide a consistent exit velocity independent of ambient pressure (i.e. depth).

SUMMARY OF THE INVENTION

The above-stated requirements are met by the invention described herein. The invention is a launching device which comprises in combination: a launching tube having a longitudinal axis which defines an axial direction; a main piston coaxial with and circumferentially surrounded by the launching tube; a gas generator disposed in the launching tube; and a dampening piston coaxial with and circumferentially surrounded by the launching tube, the dampening piston being slidable relative to the launching tube in the axial direction, and the launching tube having an axially extending series of holes formed therethrough, whereby sliding movement of the dampening piston relative to the launching tube and in the axial direction successively covers the holes.

DESCRIPTION OF THE PREFERRED EMBODIMENT

Figure 1:
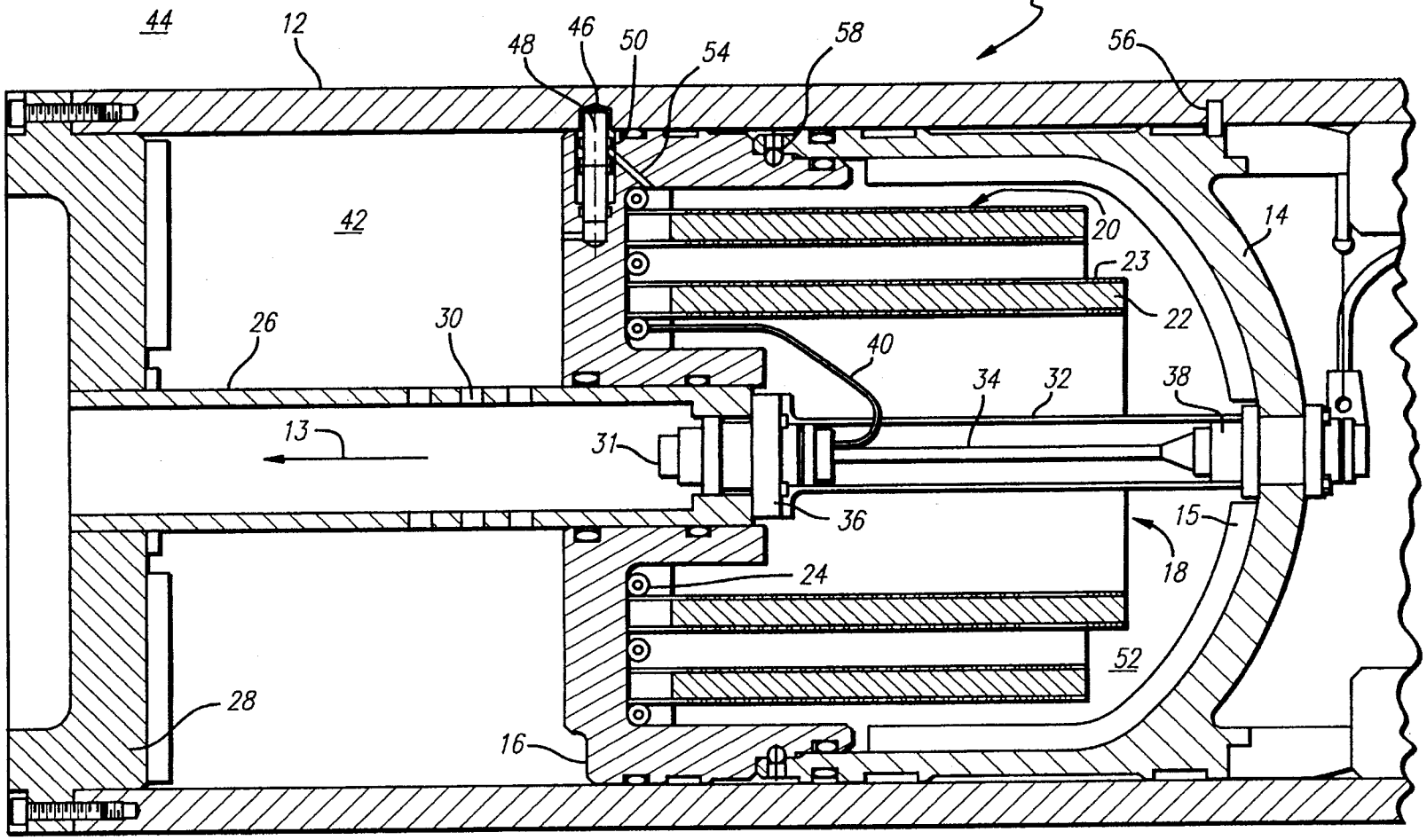
FIG. 1 is a partial cross-sectional view, somewhat schematic, of an embodiment of the invention.

Referring to FIG. 1, the curved arrow 10 designates a launching device embodying the present invention. The device is comprised of a launch tube 12 defining a longitudinal axis 13, a cylindrical launching piston 14 with an endothermic coating 15 applied thereto, a cylindrical dampening piston 16, and a gas generator 18. The generator 18 is comprised of a series of spaced, concentric cylinders (as at 20) welded to the dampening piston 16 and containing a propellant 22. The propellant 22 and an associated igniter ring (as at 24) are contained between alternate pairs of cylinders as indicated. A series of apertures (as at 23) are formed through each cylinder by conventional means. The number and shape of the apertures 23, in combination with certain properties of the chosen solid propellant, control the gasification rate of the propellant. In the preferred embodiment of the invention, a hydroxyl-terminated polybutadine with ammonium perchlorate is used as the propellant. However, any conventional pyrotechnic material consonant with the particular application may be used with the invention.

The dampening piston 16 radially surrounds and is in telescoping relation with an accumulator tube 26. The latter is welded to an end cap 28 which is rigidly connected to the launch tube 12.

A squib or initiator 31 is fitted in the accumulator tube 26 as indicated, and is connected to a tubular heat shield 32. The heat shield 32 serves to protect an electrical cable 34 that extends between electrical connectors 36, 38. Wires (as at 40) extend from the connector 36 to each of the igniter rings 24.

An axially extending series of apertures (as at 30) are formed through the accumulator tube 26. An accumulator region 42 is collectively formed by the launch tube 12, end cap 28, dampening piston 16, and accumulator tube 26. The accumulator region 42 is in fluid communication with the ambient environment 44 via the apertures 30.

The dampening piston 16 is provided with three equiangularly spaced and radially extending bores (as at 46 or,alternatively, a circumferentially machined groove), each of which receives a spring-biased piston (as at 48). The pistons 48 extend into bores (as at 50) formed in the dampening piston 16. Each spring-biased piston 48 is in fluid communication with the gas generation region 52 via passages (as at 54) which extend through the dampening piston 16 and sligthtly beyond the head of each spring-biased piston 48. The pre-launch, axial position of the dampening piston 16 relative to the launch tube 12 is thus fixed. Similarly, the pre-launch axial position of the launching piston 14 is fixed by three shear pins (as at 56). A detent coupling 58 fixes the relative positions of the launching and dampening pistons 14, 16 during handling and assembly.

In use of the launching device 10, an electric current communicated from a remote power source ignites the squib 31. The squib 31 ignites the igniter rings 24, which in turn ignite the propellant 22. Instantly, the temperature and pressure are elevated in the gas generation region 52. The increased pressure, communicated via the passages 54, actuates the spring-biased pistons 48 so that the latter are driven out of engagement with the launch tube 12. When the pressure in region 52 exceeds ambient pressure, the launching and dampening pistons 14, 16 uncouple from the detent 58, and are driven in opposite axial directions so as to enlarge the gas generation region 52 and contract the accumulator region 42. As the dampening piston is driven to the rear (to the left as viewed in the drawing), it successively covers the apertures 30. As each aperture 30 is covered, the pressure in the accumulator region 42 is increased. Accordingly, part of the energy otherwise expended in driving the launching piston 14 is used to drive the dampening piston in opposition to the pressure in the accumulator region 42. The effect on acceleration of the launching piston 14 is illustrated in FIGS. 2–5 of the drawings.

Figure 2:
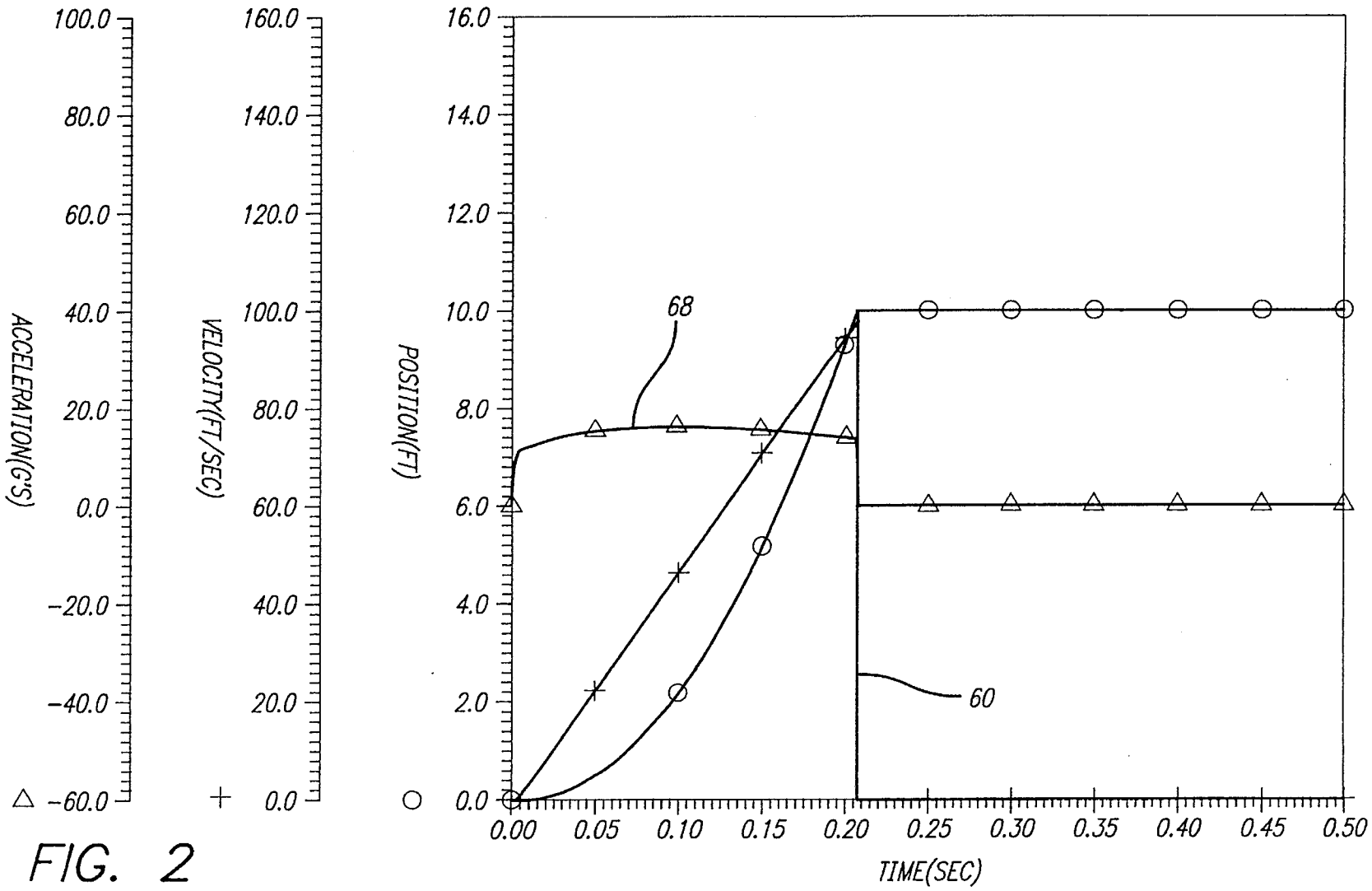
FIGS. 2–5 are comparative graphs illustrating results of computer simulation testing in which the launching device of FIG. 1 is operated with and without an accumulator at two dissimilar levels of ambient pressure.
Figure 3:
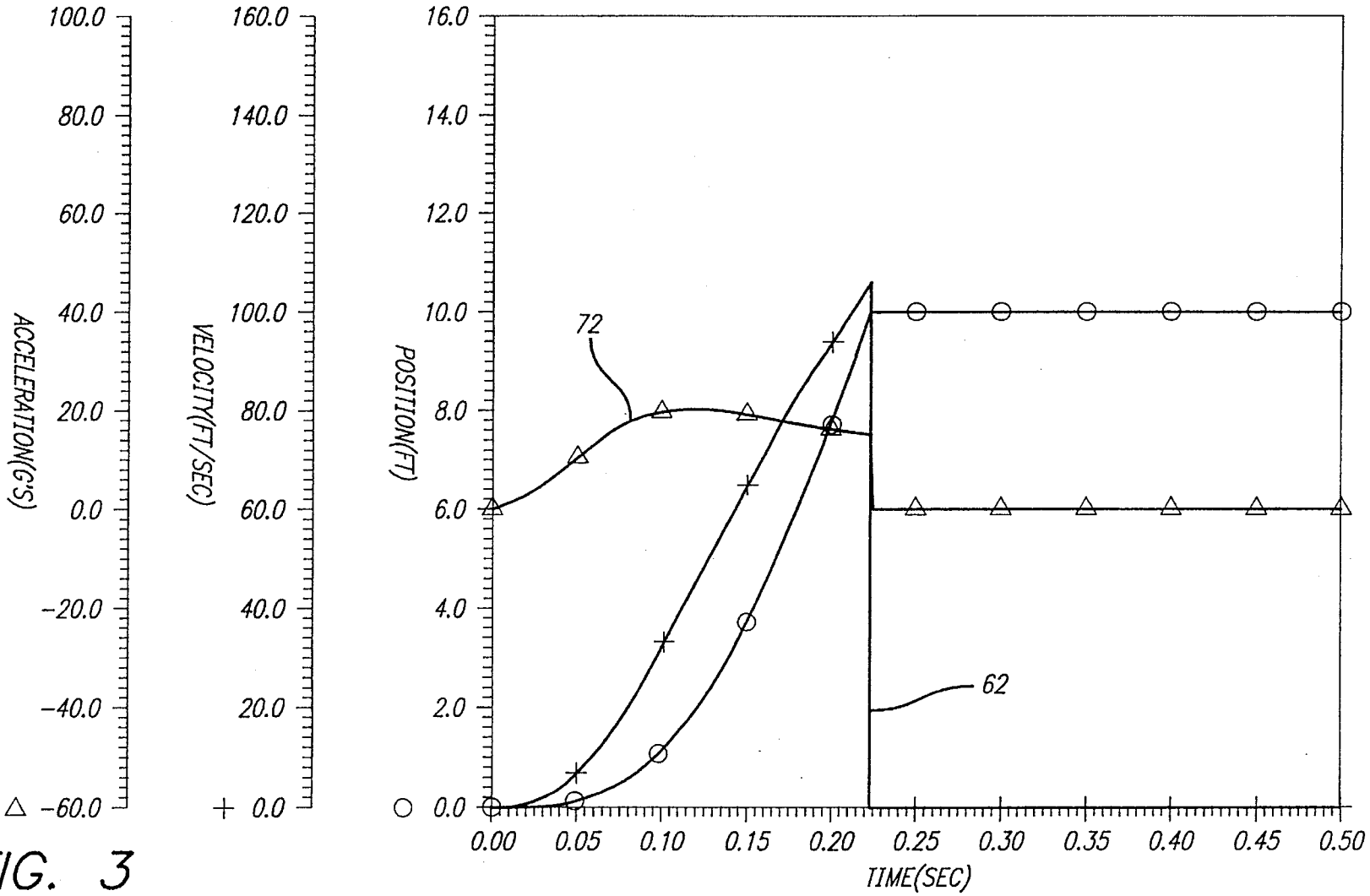
Figure 4:
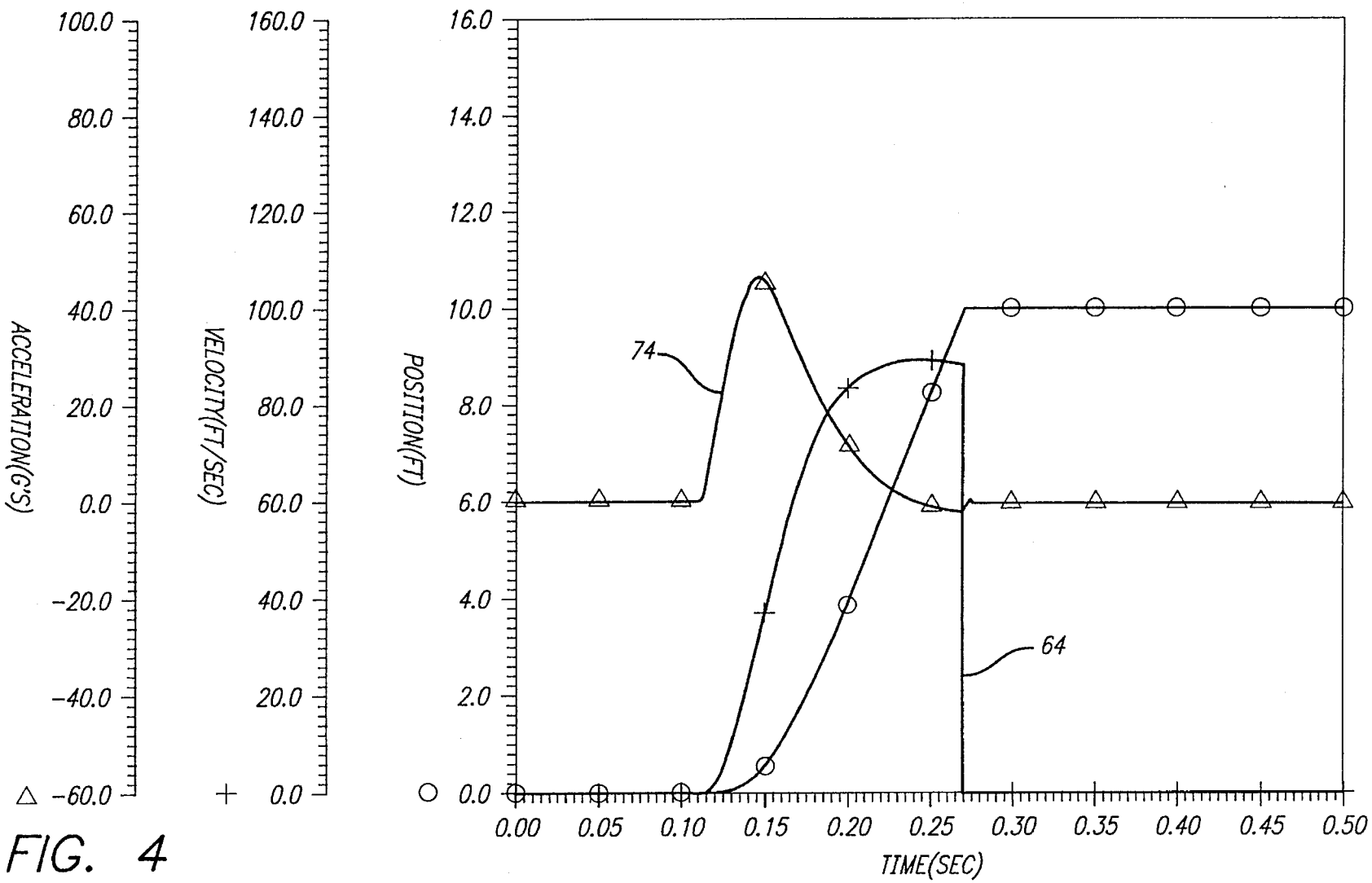
Figure 5:
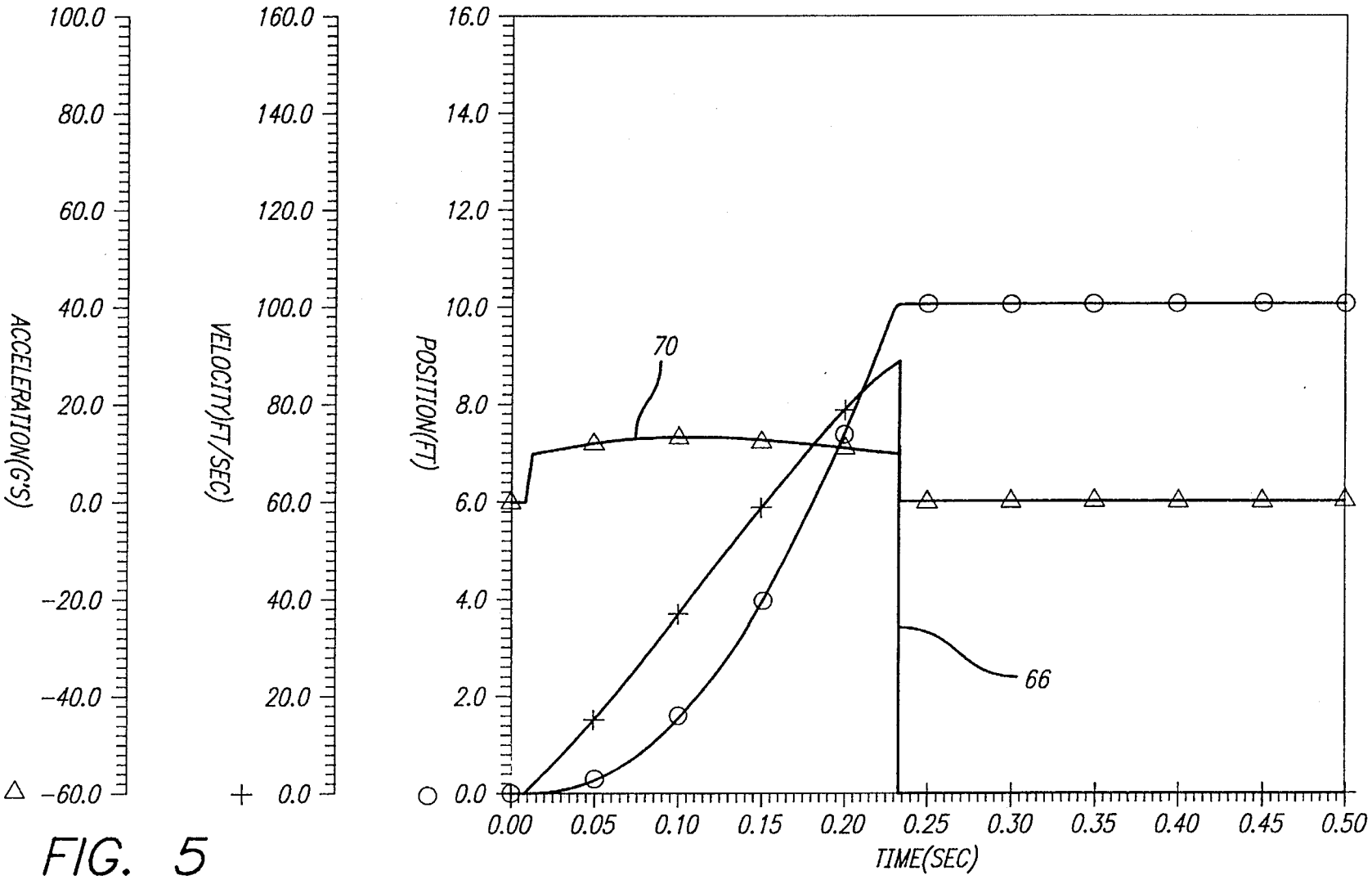

FIGS. 2 and 3 show the position, velocity, and acceleration of the launching piston 14 as functions of time. Launch is indicated by the vertical lines 60,62,64,66 in each graph. FIGS. 2 and 3 show the results with and without the accumulator region 42 and dampening piston 16, respectively, with ambient pressure at 25 pounds per square inch ("psi"). FIGS. 4 and 5 show the results without and with the accumulator region 42 and dampening piston 16, respectively, with ambient pressure at 600 psi. The acceleration curves 68, 70 associated with use of the accumulator and damping piston are relatively uniform. The acceleration curves 72, 74 associated with non-use of the accumulator and dampening piston show a relatively high degree of change in acceleration.

Figure 6:
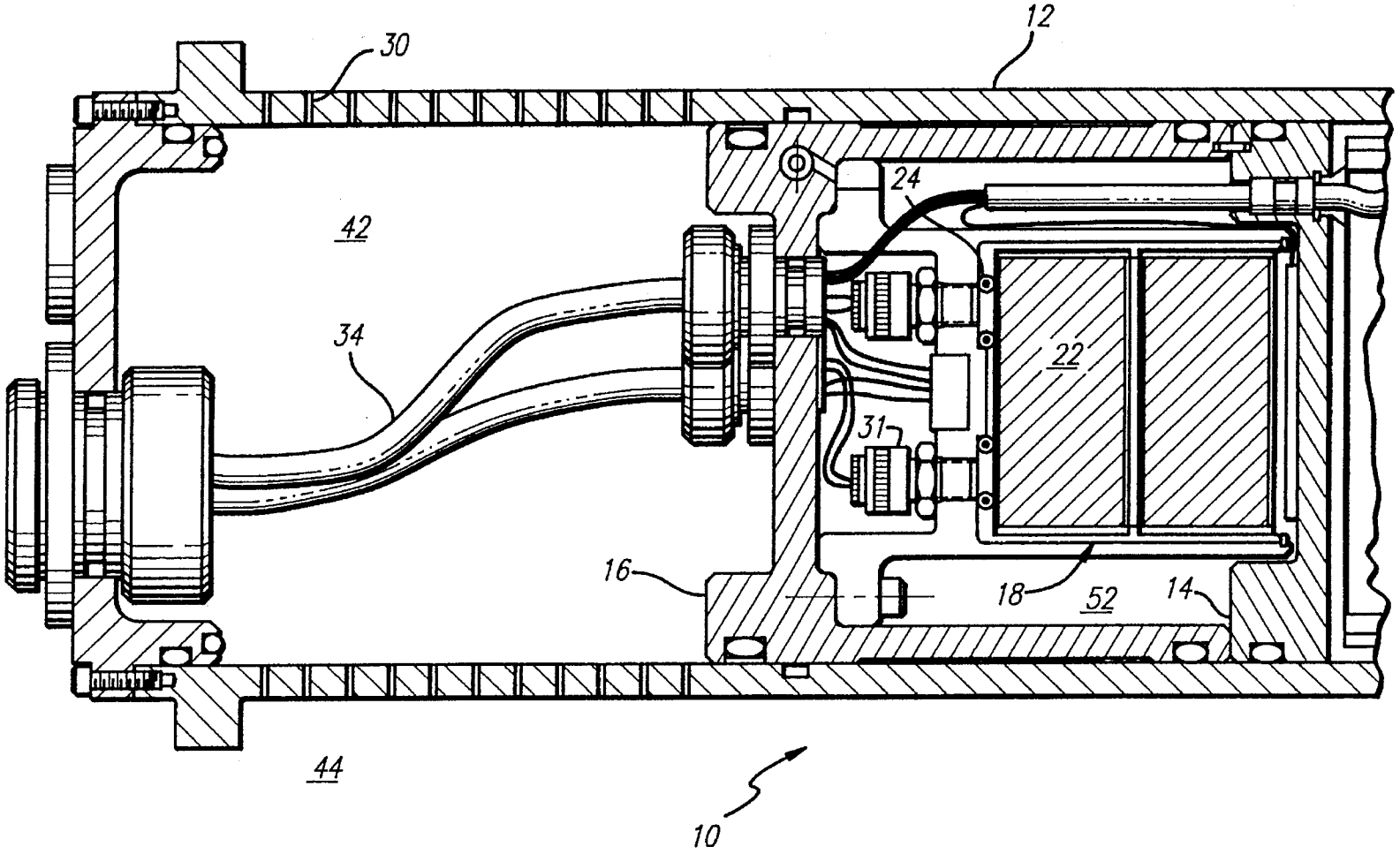
FIG. 6 is a partial cross-sectional view, again somewhat schematic, of an alternative embodiment of the invention in which the dampening tube of FIG. 1 is omitted and the gas generator is provided in the form of a rectangular enscament containing a billet-shaped pyrotechnic material.

FIG. 6 illustrates another embodiment of the invention wherein the accumulator is formed without use of the accumulator tube 26 of FIG. 1 by forming the apertures 30 through the launch tube 12.

The foregoing portion of the description, which includes the accompanying drawings, is meant to serve a pedagogical purpose and is not intended to limit the scope of the invention to specific details which are merely ancillary to the teaching contained herein.

What is claimed is:

1. A launching device, comprising in combination:

a launching tube having means for generating gas defining an axial direction thereof the generating means comprises a plurality of concentric cylinders containing a pyrotechnic material;

a main piston coaxial with and slidably disposed in the launching tube;

a dampening tube coaxial with and disposed in the launching tube;

a dampening piston coaxial with and circumferentially surrounding the dampening tube; the dampening piston being slidable on the dampening tube in the axial direction;

the dampening tube having an axially extending series of holes formed therethrough, whereby sliding movement of the dampening piston relative to the dampening tube and in the axial direction successively covers the holes.

2. A launching device as recited in claim 1 further comprising an end cap rigidly connected to the launching tube; the end cap, launching tube, and dampening piston cooperating to form an accumulator region of variable volume inside the launching tube.

3. A launching device as recited in claim 2 wherein the sliding movement of the dampening piston progressively decreases the accumulator region.

4. A launching device, comprising in combination:

a launching tube having a longitudinal axis which defines an axial direction;

a launching piston coaxial with and circumferentially surrounded by the launching tube;

work-controlled means, disposed in the launching tube, for generating gas which comprises a plurality of concentric cylinders containing a protechnic material; and a dampening piston coaxial with and circumferentially surrounded by the launching tube; the dampening piston being slidable relative to the launching tube in the axial direction; the launching tube having an axially extending series of holes formed therethrough, whereby sliding movement of the dampening piston relative to the launching tube and in the axial direction successively covers the holes.

5. A launching device as recited in claim 4 wherein the work-controlled means is connected to the dampening piston.

6. A launching device as recited in claim 2 further comprising means for generating gas within the launch tube.

7. A launching device as recited in claim 2 further comprising work-controlled means for generating gas within the launch tube.

8. A launching device as recited in claim 7 wherein the work-controlled means is rigidly secured to the dampening piston.

* * * * *